US012310498B1

(12) United States Patent
Zhang

(10) Patent No.: US 12,310,498 B1
(45) Date of Patent: May 27, 2025

(54) UNIVERSAL LEVELING CONNECTOR WITH DOUBLE SPHERICAL STRUCTURES

(71) Applicant: NINGBO HYDERON HARDWARE CO., LTD, Zhejiang (CN)

(72) Inventor: Lifeng Zhang, Zhejiang (CN)

(73) Assignee: NINGBO HYDERON HARDWARE CO., LTD, Yuyao (CN)

( * ) Notice: Subject to any disclaimer, the term of this patent is extended or adjusted under 35 U.S.C. 154(b) by 0 days.

(21) Appl. No.: 18/401,506

(22) Filed: Dec. 31, 2023

(30) Foreign Application Priority Data

Nov. 9, 2023 (CN) ..... 202311492586.3

(51) Int. Cl.
*A47B 91/16* (2006.01)

(52) U.S. Cl.
CPC ..... *A47B 91/16* (2013.01)

(58) Field of Classification Search
CPC ..... A47B 91/16
See application file for complete search history.

(56) References Cited

U.S. PATENT DOCUMENTS 2,640,219 A * 6/1953 Becker ..... A47C 7/002 16/42 T
2,748,419 A * 6/1956 Kramcsak, Jr. ..... A47B 91/066 16/42 T
2,954,636 A * 10/1960 Gammache ..... A47C 7/002 16/42 T
3,025,105 A * 3/1962 Nash ..... A47C 3/04 297/DIG. 2
3,025,557 A * 3/1962 Knowlton ..... A47B 91/066 16/42 T
3,065,494 A * 11/1962 Kramcsak, Jr. ..... A47B 91/066 16/42 R
3,166,782 A * 1/1965 Miller ..... A47B 91/066 16/42 R
3,755,853 A * 9/1973 Barile ..... A47C 7/002 297/239
5,010,621 A * 4/1991 Bock ..... B60B 33/0063 16/39
5,842,678 A * 12/1998 Svejkovsky ..... F16M 7/00 248/680
6,154,923 A * 12/2000 Carpinella ..... A47B 91/066 248/188.9
6,219,882 B1 * 4/2001 Olson ..... A47B 91/066 248/346.11

(Continued)

FOREIGN PATENT DOCUMENTS

KR 200205093 Y1 * 12/2001

*Primary Examiner* — Kimberly T Wood
(74) *Attorney, Agent, or Firm* — Jose Cherson Weissbrot

(57) ABSTRACT

A universal levelling connector with double spherical structures includes a main body, and a universal connector universally connected to the main body and the base; the spherical groove formed in the bottom surface of the main body interacts with the outer spherical surface of the connecting base in a sleeved manner, and the spherical groove wrapped by the outer spherical surface facilitates the rotation of the spherical head rivet; through the angle-limiting slope surface at the outer edge of the opening of the inner spherical groove, and through limiting the angle that the spherical head rivet inclines and rotates in the inner spherical groove to support the chair, the steel-pipe supporting legs and the chair are capable of being adjusted between 0-28 degrees.

5 Claims, 5 Drawing Sheets

(56) References Cited

U.S. PATENT DOCUMENTS

| | | | | |
|---|---|---|---|---|
| 6,354,231 | B1 * | 3/2002 | Morris | A47B 91/028 248/188.4 |
| 6,478,270 | B2 * | 11/2002 | Parisi | A47B 91/024 248/188.91 |
| 6,786,429 | B2 * | 9/2004 | Ouyoung | E03C 1/08 239/394 |
| 6,810,561 | B1 * | 11/2004 | Liu | B60B 33/0068 16/37 |
| 6,866,338 | B2 * | 3/2005 | Mendenhall | A47C 7/002 297/239 |
| 7,775,489 | B2 * | 8/2010 | Facis | A47B 91/00 248/188.4 |
| 8,607,413 | B2 * | 12/2013 | Carpinella | A47B 91/066 16/42 T |
| 2002/0088082 | A1 * | 7/2002 | Carpinella | A47B 91/066 16/42 R |
| 2015/0139724 | A1 * | 5/2015 | Carpinella | B60B 33/0002 403/361 |

* cited by examiner

UNIVERSAL LEVELING CONNECTOR WITH DOUBLE SPHERICAL STRUCTURES

TECHNICAL FIELD

This invention generally relates to the technical field of universal legs, and more particularly, to a universal levelling connector with double spherical structures.

BACKGROUND

Legs of chairs for things such as school furniture, residential furniture and hotel furniture sold on the market may be configured to be inclined according to use requirements. To facilitate the adjustment of the inclination angle of the supporting legs, the portions where supporting legs are connected to a chair normally adopts a pin shaft or a rotating shaft for rotatably connecting the supporting legs to the chair. In this type of structure, the adjustment range of the inclination angle between the supporting legs and the chair is limited, merely allowing the chair to be slightly adjusted. As a result, the requirement of a chair needing a larger inclination angle of the supporting legs cannot be met, resulting in narrowed application range.

The present invention provides a universal leveling connector with double spherical structures, which uses a spherical surface to interact with a spherical head rivet to achieve universal adjustment of rotation.

SUMMARY

The purpose of the present invention is to provide a universal levelling connector with double spherical structures.

To achieve the above purpose, the present invention adopts the following technical solution: a universal levelling connector with double spherical structures of the present invention comprises a base, a main body, and a universal connector universally connected to the main body and the base, wherein the base is provided with a connecting base with an outer spherical surface, the connecting base is provided with an inner spherical groove, and an outer edge of the opening of the inner spherical groove is provided with an angle-limiting slope surface, wherein the universal connector comprises a spherical head rivet arranged in the inner spherical groove, an anchor rod penetrating through a center connecting hole of the main body, and a spring piece arranged at the top end of the anchor rod and limiting the top end of the anchor rod at the top of the main body, wherein a spherical groove formed at the bottom of the main body interacts with the outer spherical surface of the connecting base in a sleeved manner, the main body interacts with the outer spherical surface through the spherical groove such that a universal rotation is achieved, and the universal connector inside the main body rotatably interacts with the inner spherical groove in a limiting manner.

In another embodiment of the present invention, an upper portion of the anchor rod is provided with a limiting area having a diameter smaller than that of the anchor rod, the limiting area is sleeved with a metal washer, and the metal washer interacts with the anchor rod and the limiting groove at the bottom of the connecting hole to realize the limitation, thereby maintaining the stability of the connection between the anchor rod and the main body. When the anchor rod penetrates through the connecting hole, the metal washer is located at the bottom of the limiting area, and when the top end of the anchor rod is located at the top end of the main body and fixed to the spring piece, the metal washer is located at the bottom end of the limiting area and is attached to the limiting groove, thereby achieving limited connection between the anchor rod and the main body while maintaining the stability of the connection between the anchor rod and the main body.

In another embodiment of the present invention, an outer portion of the main body is provided with a vertical limiting plate interacting with a steel-pipe supporting leg in a sleeved manner, and a steel-pipe sleeving area is formed between the main body and an outer side of the vertical limiting plate. The vertical limiting plate is clamped into a tail end of the steel-pipe supporting leg needing to be connected to a chair through the steel-pipe sleeving area, thereby realizing the connection between the main body and the steel-pipe supporting leg.

In another embodiment of the present invention, a plurality of elastic abutting pieces arranged at an outer edge of the spring piece extend out from an outer side of the vertical limiting plate, and the plurality of elastic abutting pieces are uniformly distributed on the outer edge of the spring piece. When the steel-pipe supporting leg is sleeved in the steel-pipe sleeving area, the spring piece is located in the steel-pipe supporting leg, and the elastic abutting piece on the outer edge of the spring piece is tensioned on an inner wall of the steel-pipe supporting leg, so that the connecting stability of the steel-pipe supporting leg and the main body is kept and the steel-pipe supporting leg is prevented from being separated from the main body.

In another embodiment of the present invention, an outer edge of the top end of the anchor rod is anchored to the center of the spring piece to limit the top end of the anchor rod by means of the spring piece, and the top end of the anchor rod is limited on the main body while the spring piece is fixed to the top end of the anchor rod, thereby improving the stability of the connection between the steel-pipe support leg and the base by means of the interaction between the main body and the universal connector.

In another embodiment of the present invention, the base may be a nylon base, a felt base, a metal base, or a Teflon base.

Compared with the prior art, the present invention has the following advantages:

The chair is connected to the steel-pipe supporting legs by means of universal connectors; the base is provided with a connecting base with an inner spherical groove and an outer spherical surface, and the connecting base is rotatably connected to the main body through the universal connector; the base is used to interact with the steel-pipe supporting legs, thereby allowing the steel-pipe supporting legs to be conveniently connected to the chair; after the steel-pipe supporting legs and the main body are fixed in a sleeved manner, because the spherical head rivet on the universal connector is located in the inner spherical groove of the connecting base, and the spherical groove formed in the bottom surface of the main body is connected to the outer spherical surface of the connecting base in an interacting manner, when the steel-pipe supporting legs connected to the main body need to rotate to adjust the angle for supporting the chair, the spherical head rivet rotates in the inner spherical groove, and the spherical groove wrapped by the outer spherical surface facilitates the rotation of the spherical head rivet; at this point, through the angle-limiting slope surface at the outer edge of the opening of the inner spherical groove, and through limiting the angle that the spherical head rivet inclines and rotates in the inner spherical groove to support the chair, the steel-pipe supporting legs and the chair are capable of being adjusted between 0-28 degrees; in this way, the flexibility of connection between the steel-pipe supporting legs and the chair is significantly improved and the application range is greatly widened;

The top end of the anchor rod of the universal connector is limited at the top end of the main body through the spring piece; therefore, when the steel-pipe supporting leg is sleeved in the steel-pipe sleeving area, the spring piece is located inside the steel-pipe supporting leg; at this point, the elastic abutting piece on the outer edge of the spring piece is tensioned on the inner wall of the steel-pipe supporting leg, so that the connecting stability of the steel-pipe supporting leg and the main body is kept and the steel-pipe supporting leg is prevented from being separated from the main body; thus, high reliability of connection between the steel-pipe supporting leg and the main body is achieved.

In Figures: 1—Base, 2—Main Body, 3—Universal Connector, 4—Outer Spherical Surface, 5—Connecting Base, 6—Inner Spherical Groove, 7—Angle-limiting Slope Surface, 8—Spherical Head Rivet, 9—Connecting Hole, 10—Anchor Rod, 11—Spring Piece, 12—Spherical Groove, 13—Limiting Area, 14—Metal Washer, 15—Vertical Limiting Plate, 16—Steel-pipe Sleeving Area, 17—Elastic Abutting Piece.

DETAILED DESCRIPTION

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

Figure 1:
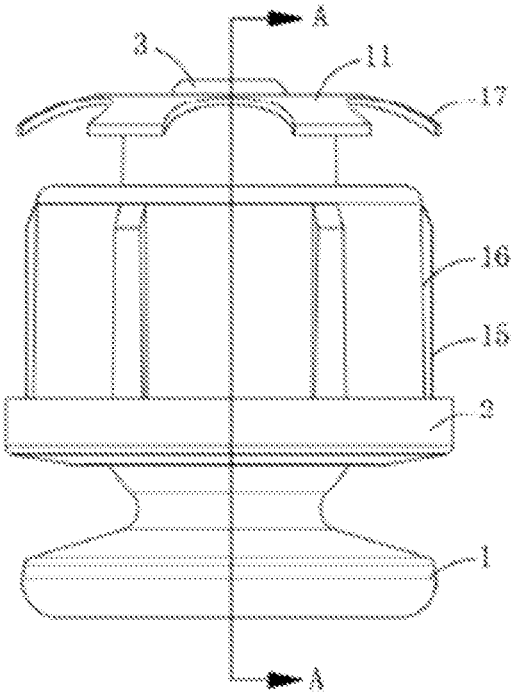
FIG. 1 is a schematic diagram illustrating an exemplary structure of the present invention.
Figure 2:
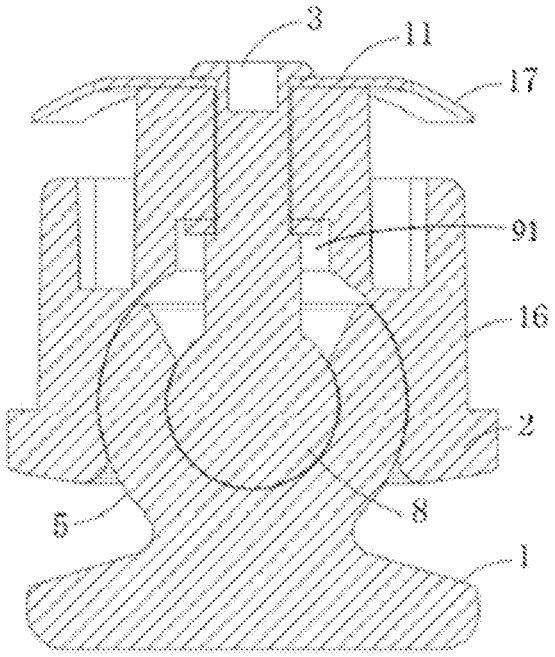
FIG. 2 is a schematic diagram illustrating a sectional view along line A-A in FIG. 1.
Figure 3:
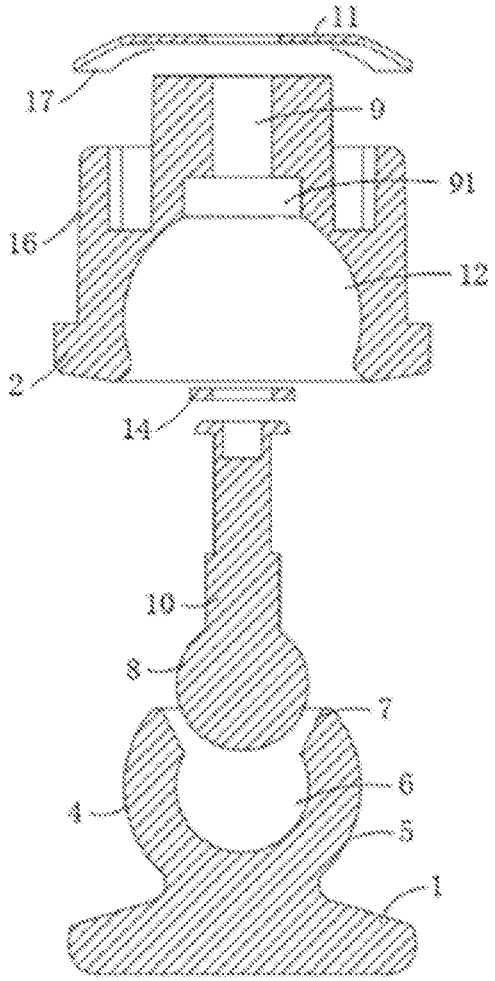
FIG. 3 is a schematic diagram illustrating an explosive view of FIG. 2.
Figure 4:
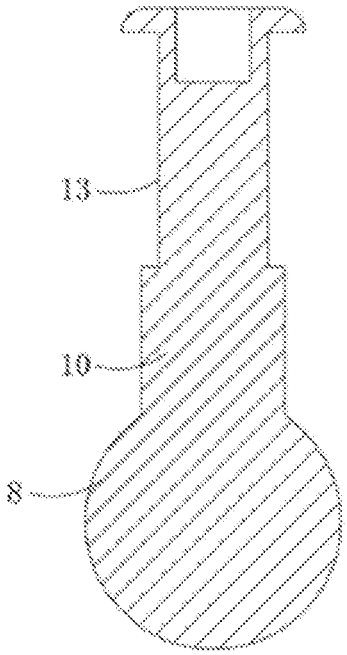
FIG. 4 is a schematic diagram illustrating an exemplary structure of the universal connector of the present invention.
Figure 5:
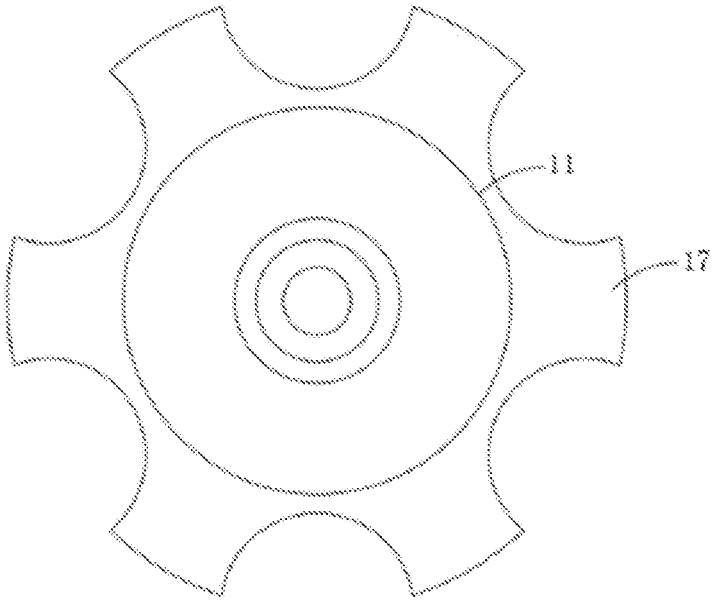
FIG. 5 is a schematic diagram illustrating an exemplary structure of the spring piece of the present invention.

Referring to FIGS. 1-5, the present invention provides a universal levelling connector with double spherical structures. The universal levelling connector with double spherical structures of the present invention comprises a base 1, a main body 2, and a universal connector 3 universally connected to the main body 2 and the base 1. The base 1 is provided with a connecting base 5 with an outer spherical surface 4, the connecting base 5 is provided with an inner spherical groove 6, and an outer edge of the opening of the inner spherical groove 6 is provided with an angle-limiting slope surface 7.

The universal connector 3 comprises a spherical head rivet 8 arranged in the inner spherical groove 6, an anchor rod 10 penetrating through a center connecting hole 9 of the main body 2, and a spring piece 11 arranged at the top end of the anchor rod 10 and defining the top end of the anchor rod 10 at the top of the main body 2.

A spherical groove 12 formed at the bottom of the main body 2 interacts with the outer spherical surface 4 of the connecting base 5 in a sleeved manner, and the main body 2 interacts with the outer spherical surface 4 through the spherical groove 12 such that a universal rotation is achieved. The universal connector 3 inside the main body 2 rotatably interacts with the inner spherical groove 6 in a limiting manner.

An upper portion of the anchor rod 10 is provided with a limiting area 13 having a diameter smaller than that of the anchor rod 10, the limiting area 13 is sleeved with a metal washer 14, and the metal washer 14 interacts with the anchor rod 10 and the limiting groove at the bottom of the connecting hole 9 to realize the limitation, thereby maintaining the stability of the connection between the anchor rod 10 and the main body 2. When the anchor rod 10 penetrates through the connecting hole 9, the metal washer 14 is located at the bottom of the limiting area 13, and when the top end of the anchor rod 10 is located at the top end of the main body 2 and fixed to the spring piece 11, the metal washer 14 is located at the bottom end of the limiting area 13 and is attached to the limiting groove, thereby achieving limited connection between the anchor rod 10 and the main body 2 while maintaining the stability of the connection between the anchor rod 10 and the main body 2.

An outer portion of the main body 2 is provided with a vertical limiting plate 15 interacting with a steel-pipe supporting leg in a sleeved manner, and a steel-pipe sleeving area 16 is formed between the main body 2 and an outer side of the vertical limiting plate 15. The vertical limiting plate 15 is clamped into a tail end of the steel-pipe supporting leg needing to be connected to a chair through the steel-pipe sleeving area 16, thereby realizing the connection between the main body 2 and the steel-pipe supporting leg.

A plurality of elastic abutting pieces 17 arranged at an outer edge of the spring piece 11 extend out from an outer side of the vertical limiting plate 15, and the plurality of elastic abutting pieces 17 are uniformly distributed on the outer edge of the spring piece 11. When the steel-pipe supporting leg is sleeved in the steel-pipe sleeving area 16, the spring piece 11 is located in the steel-pipe supporting leg, and the elastic abutting piece 17 on the outer edge of the spring piece 11 is tensioned on an inner wall of the steel-pipe supporting leg, so that the connecting stability of the steel-pipe supporting leg and the main body 2 is kept and the steel-pipe supporting leg is prevented from being separated from the main body 2.

An outer edge of the top end of the anchor rod 10 is anchored to the center of the spring piece 11 to limit the top end of the anchor rod 10 by means of the spring piece 11, and the top end of the anchor rod 10 is limited on the main body 2 while the spring piece 11 is fixed to the top end of the anchor rod 10, thereby improving the stability of the connection between the steel-pipe support leg and the base 1 by means of the interaction between the main body 2 and the universal connector 3.

The base 1 may be a nylon base, a felt base, a metal base, or a Teflon base.

The chair is connected to the steel-pipe supporting legs by means of universal connectors. The base 1 is provided with a connecting base 5 with an inner spherical groove 6 and an outer spherical surface 4, and the connecting base 5 is rotatably connected to the main body 2 through the universal connector 3. The base 1 is used to interact with the steel-pipe supporting legs, thereby allowing the steel-pipe supporting legs to be conveniently connected to the chair. After the steel-pipe supporting legs and the main body 2 are fixed in a sleeved manner, because the spherical head rivet 8 on the universal connector 3 is located in the inner spherical groove 6 of the connecting base 5, and the spherical groove 12 formed in the bottom surface of the main body 2 is connected to the outer spherical surface 4 of the connecting base 5 in an interacting manner, when the steel-pipe supporting legs connected to the main body 2 need to rotate to adjust the angle for supporting the chair, the spherical head rivet 8 rotates in the inner spherical groove 6, and the spherical groove 12 wrapped by the outer spherical surface 4 facilitates the rotation of the spherical head rivet 8. At this point, through the angle-limiting slope surface 7 at the outer edge of the opening of the inner spherical groove 6, and through limiting the angle that the spherical head rivet 8 inclines and rotates in the inner spherical groove 6 to support the chair, the steel-pipe supporting legs and the chair are capable of being adjusted between 0-28 degrees. In this way, the flexibility of connection between the steel-pipe supporting legs and the chair is significantly improved and the application range is greatly widened.

The top end of the anchor rod 10 of the universal connector 3 is limited at the top end of the main body 2 through the spring piece 11. Therefore, when the steel-pipe supporting leg is sleeved in the steel-pipe sleeving area, the spring piece 11 is located inside the steel-pipe supporting leg. At this point, the elastic abutting piece 17 on the outer edge of the spring piece 11 is tensioned on the inner wall of the steel-pipe supporting leg, so that the connecting stability of the steel-pipe supporting leg and the main body 2 is kept and the steel-pipe supporting leg is prevented from being separated from the main body 2. Thus, high reliability of connection between the steel-pipe supporting leg and the main body 2 is achieved.

Although embodiments of the present invention have been described, for those skilled in the art, changes, modifications, replacements and variations may be made to these embodiments without departing from the principles and spirit of the present invention. The scope of the present invention is defined by the claims and their equivalents.

The invention claimed is:

1. A universal leveling connector with double spherical structures, comprising:

a base (1), a main body (2), and a universal connector (3) universally connected to the main body (2) and the base (1), wherein the base (1) is provided with a connecting base (5) with an outer spherical surface (4), the connecting base (5) is provided with an inner spherical groove (6), and an outer edge of the opening of the inner spherical groove (6) is provided with an angle-limiting slope surface (7), wherein the universal connector (3) further comprises:

a spherical head rivet (8) arranged in the inner spherical groove (6), an anchor rod (10) penetrating through a center connecting hole (9) of the main body (2), and a spring piece (11) arranged at the top end of the anchor rod (10) and limiting the top end of the anchor rod (10) at the top of the main body (2), wherein a spherical groove (12) formed at bottom of the main body (2) interacts with the outer spherical surface (4) of the connecting base (5) in a sleeved manner, the main body (2) interacts with the outer spherical surface (4) through the spherical groove (12) such that a universal rotation is achieved, and the universal connector (3) inside the main body (2) rotatably interacts with the inner spherical groove (6) in a limiting manner;

wherein an upper portion of the anchor rod (10) is provided with a limiting area (13) having a diameter smaller than a diameter of the anchor rod (10), wherein the limiting area (13) is sleeved with a metal washer (14), wherein the metal washer (14) interacts with the anchor rod (10) and the limiting groove (91) at bottom of the connecting hole (9).

2. The universal leveling connector with double spherical structures of claim 1, wherein an outer portion of the main body (2) is provided with a vertical limiting plate (15) interacting with a steel-pipe supporting leg in a sleeved manner, and wherein a steel-pipe sleeving area (16) is formed between the main body (2) and an outer side of the vertical limiting plate (15).

3. The universal levelling connector with double spherical structures of claim 2, wherein a plurality of elastic abutting pieces (17) arranged at an outer edge of the spring piece (11) extend out from an outer side of the vertical limiting plate (15), and wherein the plurality of elastic abutting pieces (17) are uniformly distributed on the outer edge of the spring piece (11).

4. The universal leveling connector with double spherical structures of claim 1, wherein an outer edge of top end of the anchor rod (10) is anchored to the center of the spring piece (11) to limit the top end of the anchor rod (10) by the spring piece (11).

5. The universal levelling connector with double spherical structures of claim 1, wherein the base (1) is a nylon base, a felt base, or a metal base.

* * * * *